US008183963B2

(12) United States Patent
Fujimoto et al.

(10) Patent No.: US 8,183,963 B2
(45) Date of Patent: May 22, 2012

(54) ELECTROMAGNETIC RELAY AND METHOD OF MAKING THE SAME

(75) Inventors: Koji Fujimoto, Yamaga (JP); Shinichi Furusho, Kumamoto (JP); Akifumi Fujino, Yamaga (JP)

(73) Assignee: OMRON Corporation, Kyoto (JP)

( * ) Notice: Subject to any disclaimer, the term of this patent is extended or adjusted under 35 U.S.C. 154(b) by 231 days.

(21) Appl. No.: 12/714,319

(22) Filed: Feb. 26, 2010

(65) Prior Publication Data

US 2010/0225427 A1 Sep. 9, 2010

(30) Foreign Application Priority Data

Mar. 6, 2009 (JP) ..... 2009-053958

(51) Int. Cl.
*H01H 51/22* (2006.01)

(52) U.S. Cl. ..... 335/78

(58) Field of Classification Search ..... 335/78–83
See application file for complete search history.

(56) References Cited

U.S. PATENT DOCUMENTS

| | | | | |
|---|---|---|---|---|
| 4,695,813 | A * | 9/1987 | Nobutoki et al. | 335/78 |
| 4,914,411 | A * | 4/1990 | Hikita et al. | 335/128 |
| 5,191,306 | A * | 3/1993 | Kaji et al. | 335/78 |
| 5,304,970 | A * | 4/1994 | Okamoto et al. | 335/78 |
| 5,396,204 | A * | 3/1995 | Matsuoka et al. | 335/78 |
| 5,548,259 | A * | 8/1996 | Ide et al. | 335/78 |
| 5,757,255 | A * | 5/1998 | Noda et al. | 335/78 |
| 6,633,214 | B2 * | 10/2003 | Mochizuki | 335/128 |
| 6,771,153 | B2 * | 8/2004 | Mochizuki | 335/78 |
| 2002/0057147 | A1 * | 5/2002 | Shinoura et al. | 335/78 |

FOREIGN PATENT DOCUMENTS

EP 1298690 A1 4/2003

* cited by examiner

*Primary Examiner* — Lincoln Donovan
*Assistant Examiner* — Alexander Talpalatskiy
(74) *Attorney, Agent, or Firm* — Rabin & Berdo, P.C.

(57) ABSTRACT

A electromagnetic relay in which bad electrical contact and failure of operation are prevented even when shavings are produced while an iron core is press-fitted into and mounted on a base. The electromagnetic relay includes an electromagnetic block supported by press-fitting both ends of an iron core of the electromagnetic block into an upper surface of a base and open or close a contact by a movable iron piece rotated by magnetization or demagnetization of the iron core with a coil, where shaving receptacles are made by forming separating ribs adjacent to at least one side of press-fit projections that are formed in press-fit concave portions provided on the upper surface of the base.

3 Claims, 15 Drawing Sheets

ELECTROMAGNETIC RELAY AND METHOD OF MAKING THE SAME

BACKGROUND

The present invention is related to an electromagnetic relay, more specifically to an electromagnetic relay in which bad electrical contact and failure of operation caused by shavings that are produced when an iron core is press-fitted into and mounted on a base are prevented.

Conventionally, when assembling an electromagnetic relay by press-fitting an iron core of an electromagnetic block into a base, it is known to mount a flat terminal 40 on a base housing 10, for example as shown in FIG. 2 of Japanese Patent 3934376. In the above-mentioned electromagnetic relay, shavings are produced when the flat terminal 40 is mounted on the base housing 10 by press-fitting lower ends of leg parts 42 and 43 of the flat terminal 40 into the base housing 10.

Since the shavings are scattered and moved around in the housing, there is a problem that they may cause bad electrical contact or failure of operation when they touch a movable contact or an armature 60.

BRIEF SUMMARY

An electromagnetic relay according to the present invention is constructed such that both ends of an iron core of an electromagnetic block are press-fitted into a base, opening or closing a contact by a movable iron piece rotated by magnetization or demagnetization of the iron core with a coil of the electromagnetic block, wherein a press-fit projection is formed in a press-fit concave portion provided on the upper surface of the base and a shaving receptacle is made by a separating rib that is formed adjacent to at least one side of the press-fit projection.

DETAILED DESCRIPTION

Embodiments according to the invention are described with reference to FIGS. 1 to 11. An electromagnetic relay according to this embodiment includes a base 10, an electromagnetic block 30, an armature 60 and a case 70 as shown in FIGS. 1 to 10.

Figure 3A:
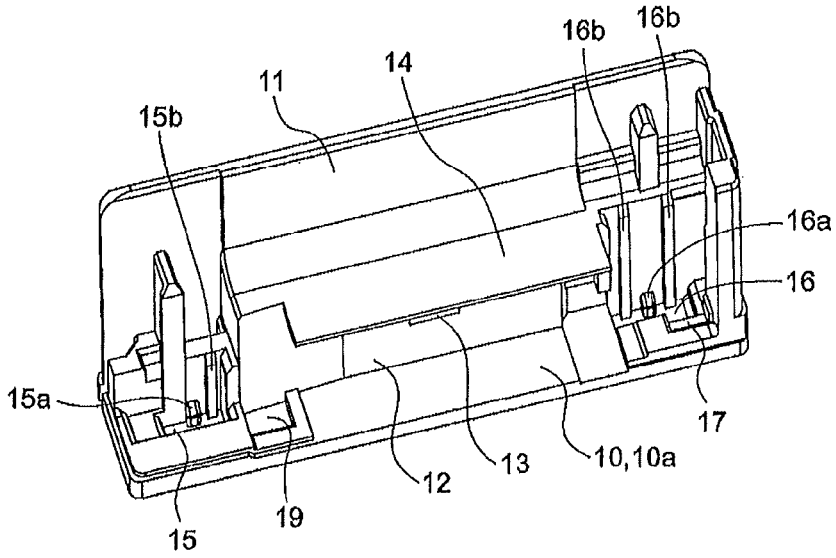
FIG. 3A is a perspective view of a base shown in FIG. 2
Figure 10A:
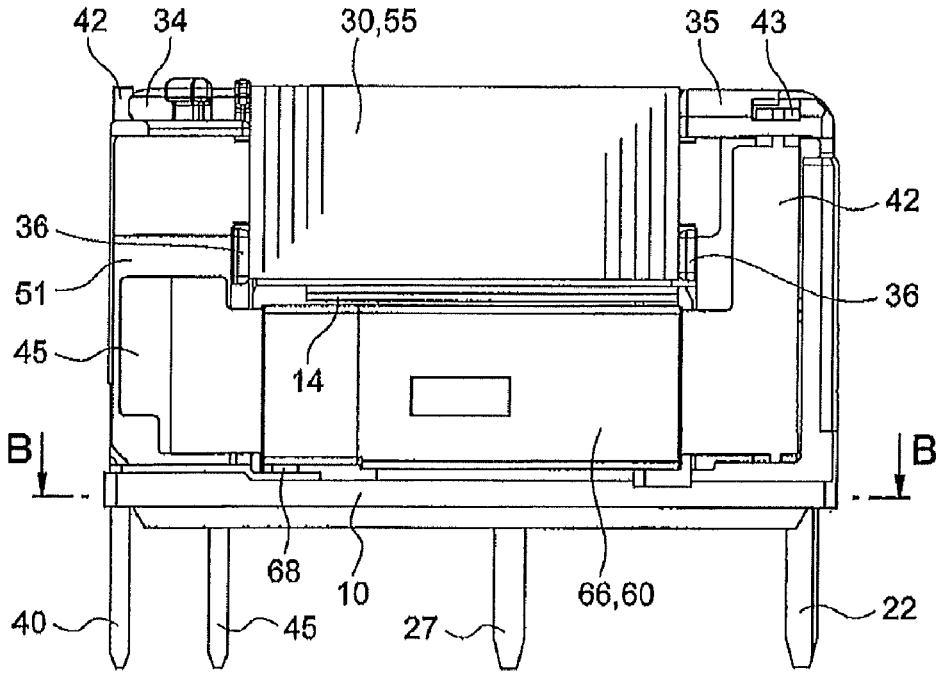
FIG. 10A is a front view of the electromagnetic relay shown in FIG. 2.
Figure 10B:
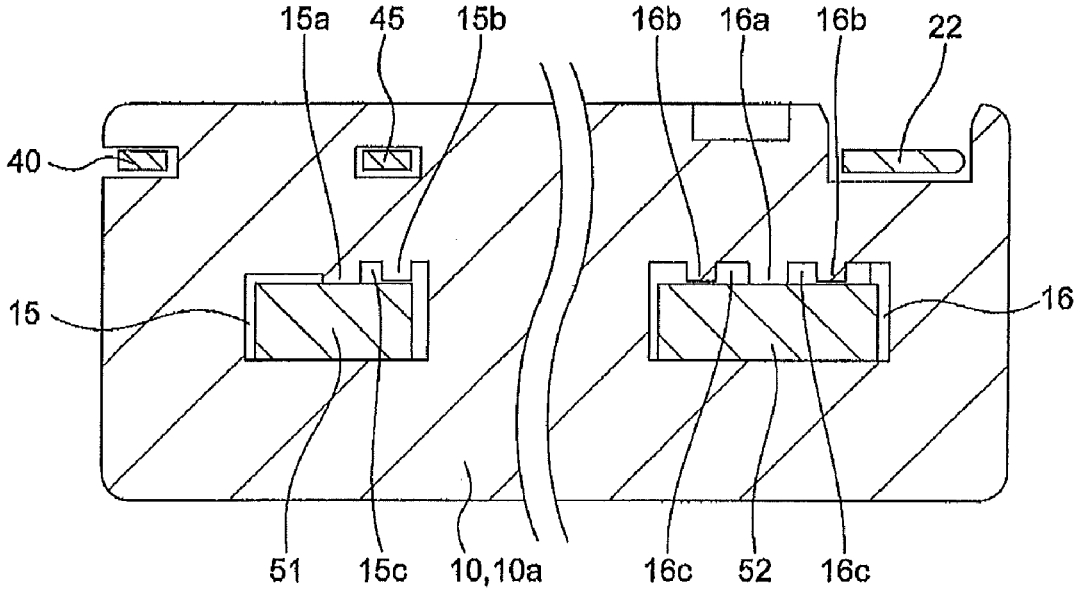
FIG. 10B is a partially enlarged cross-sectional view of FIG. 10A taken along a line B-B.

The base 10 has a substantially L-shaped flat partition wall 11 standing along a periphery of an upper surface of a substantially rectangular flat base part 10*a* while the partition wall 11 has a bulge part 12 formed at a substantially middle portion thereof for securing a contact space. Further, an insulating wall 14 laterally extends from an upper surface of the bulge part 12 between after-mentioned electromagnetic block 30 and armature 60. Press-fit concave portions 15 and 16 for press fitting both ends of an after-mentioned iron core 50 are provided respectively at both sides of the bulge part 12 on the upper surface of the base part 10*a*. The press-fit concave portion 15 has a shaving receptacle 15*c* formed by a separating rib 15*b* which is provided in a vertical direction at one side of a press-fit projection 15*a* as shown in FIG. 10B. Similarly, the press-fit concave portion 16 has shaving receptacles 16*c*, 16*c* formed by separating ribs 16*b*, 16*b* that are provided respectively in a vertical direction at both sides of a press-fit projection 16*a*. As such, the shaving receptacles 15*c* and 16*c* may hold the shavings which are produced when both end parts 51 and 52 of the iron core 50 are press-fitted into the press-fit concave portions 15 and 16. Since the shavings are held by the shaving receptacles 15*c* and 16*c* and not scattered and lost, bad electrical contact and failure of operation may be advantageously avoided. Further, a bearing part 17 for rotatably supporting a convex portion 64 of a rotating shaft of the armature 60 is provided closely adjacent to the press-fit concave portion (FIG. 8C). Further, a positioning concave portion 19 is provided at the side of the press-fit concave portion 15 on the base part 10 to have a stopper 68 of the armature 60 inserted therein as shown in FIG. 3A.

Figure 3B:
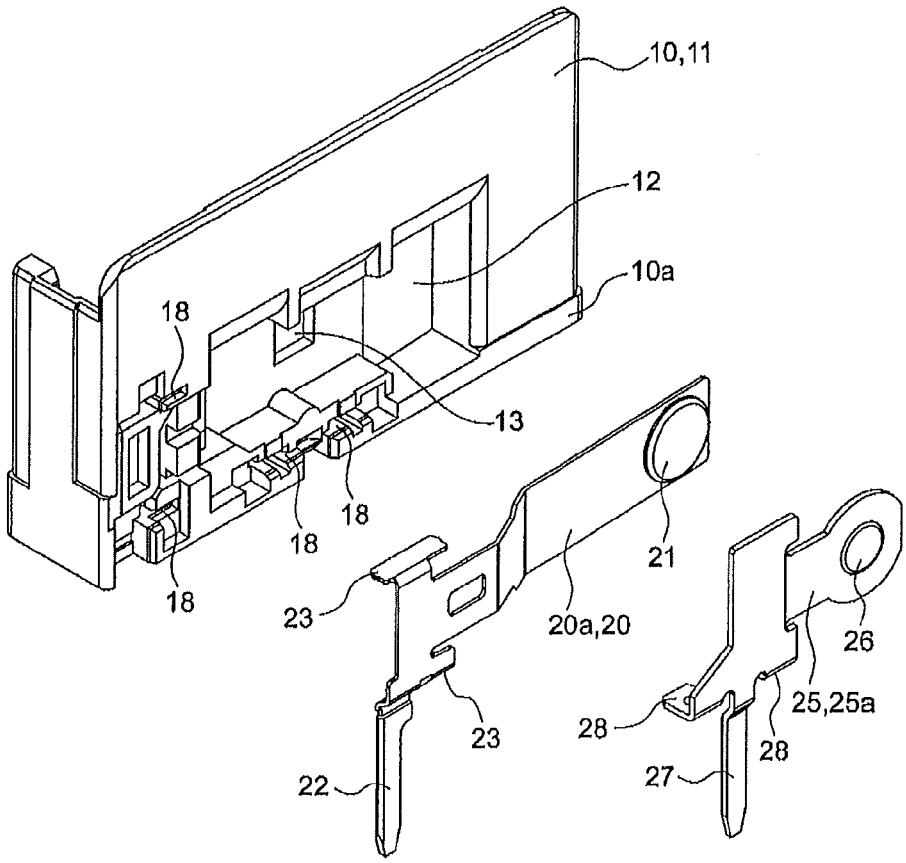
FIG. 3B is an exploded perspective view including the base shown in FIG. 2.

Further, a movable contact terminal 20 and a fixed contact terminal 25 are mounted on the base 10 as shown in FIG. 3. The movable contact terminal 20 has a movable contact piece 20*a* and a movable contact 21 is provided on one end of the movable contact piece 20*a* while a terminal part 22 and a press-fit rib 23 are provided on the other end of the movable contact piece 20*a*. On the other hand, the fixed contact terminal 25 has a fixed contact piece 25*a* and a fixed contact 26 is provided on one end of the fixed contact piece 25*a*, while a terminal part 27 and a press-fit rib 28 are provided on the other side of the fixed contact piece 25*a*. The press-fit rib 23 of the movable contact terminal 20 and the press-fit rib 28 of the fixed contact terminal 25 are press-fitted in press-fit receiving parts 18, 18 respectively such that the movable contact 21 faces the fixed contact 26, enabling the movable contact 21 to come into contact with or separate from the fixed contact 26 in the bulge part 12, while the movable contact piece 20*a* can be operated through an operational opening 13 of the bulge part 12 as shown in FIG. 3B.

Figure 4A:
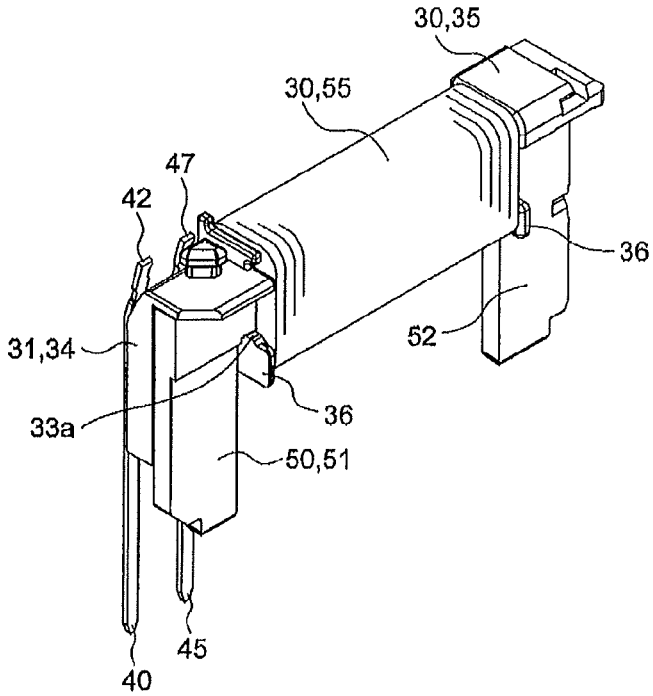
FIGS. 4A and 4B are perspective views showing an electromagnetic block shown in FIG. 2 viewed from different angles respectively.
Figure 6A:
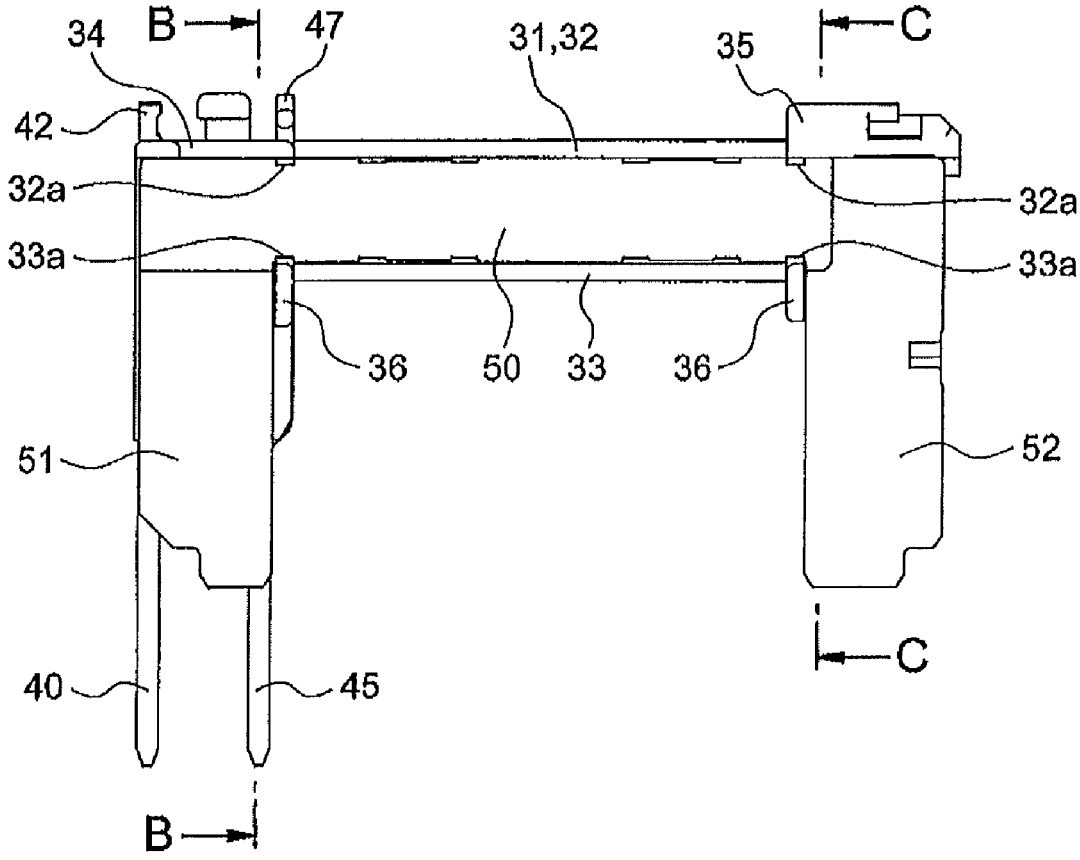
FIG. 6A is a front view of the electromagnetic block shown in FIGS. 4A and 4B without coil.
Figure 6B:
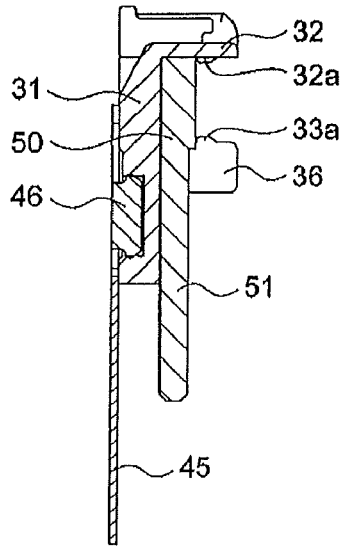
FIGS. 6B and 6C are cross-sectional views of FIG. 6A taken along lines B-B and C-C respectively.
Figure 6C:
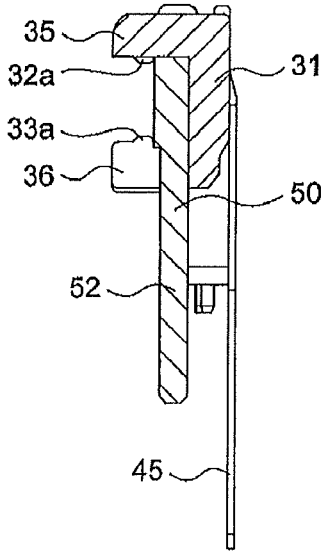

The electromagnetic block 30 is configured such that a coil 55 is to be wound around a spool 31 on which coil terminals 40 and 45 and a portal shaped iron core 50 are mounted as shown in FIGS. 4 and 6. At each end of the spool 31, the ends of upper spool 32 and lower spool 33 are joined by joints 34 and 35 respectively, and projecting parts 36, 36 project laterally from both ends of the lower spool 33. The portal shaped iron core 50 is mounted between the upper spool 32 and lower spool 33 by positioning projections 33*a*, 33*a*, while press-fit ribs 41 and 46 of a pair of coil terminals 40 and 45 are laterally press-fitted into the joint 34 respectively. As such, the portal shaped iron core 50 is mounted between the upper spool 32 and the lower spool 33 of the spool 31 by the projecting parts 36, 36, and lead wires of the coil 55 are twisted around fixing parts 42 and 47 of the coil terminals 40 and 45 and soldered respectively after the coil 55 is wound around the spool 31.

Figure 4B:
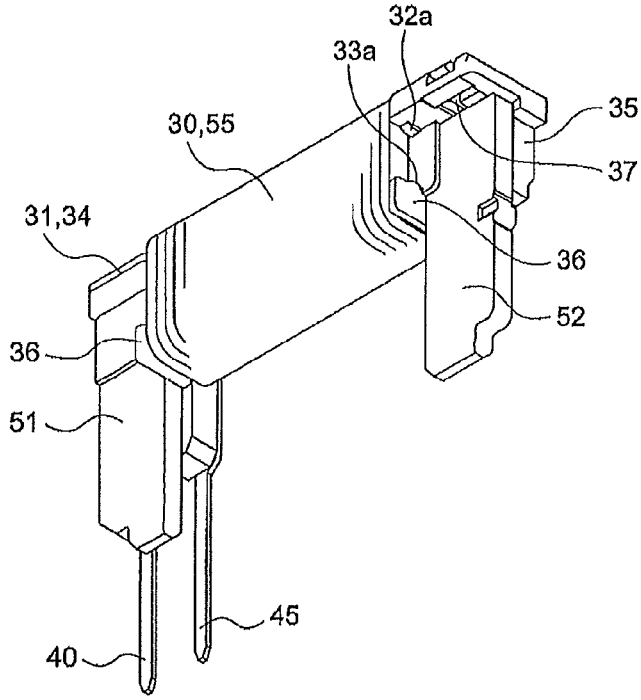
Figure 5:
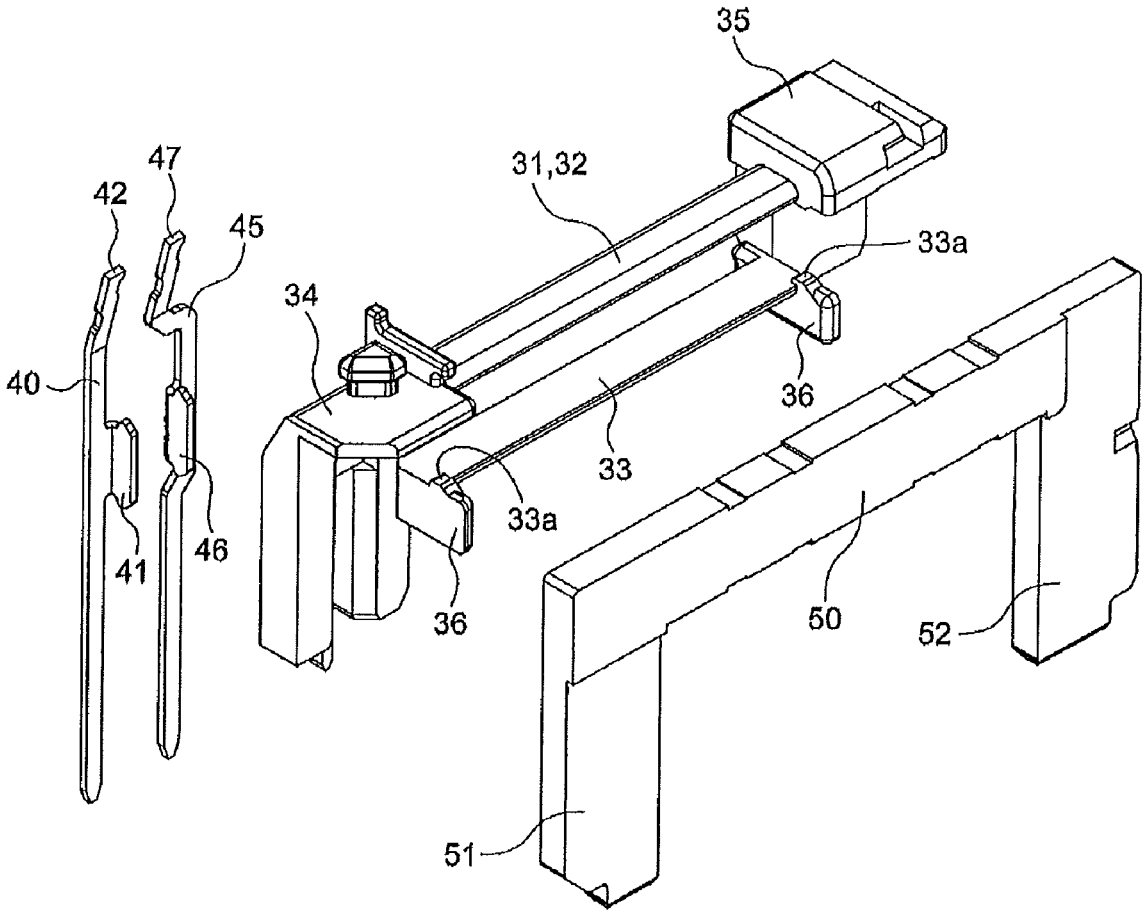
FIG. 5 is an exploded perspective view of a major part of the electromagnetic block shown in FIGS. 4A and 4B.
Figure 8A:
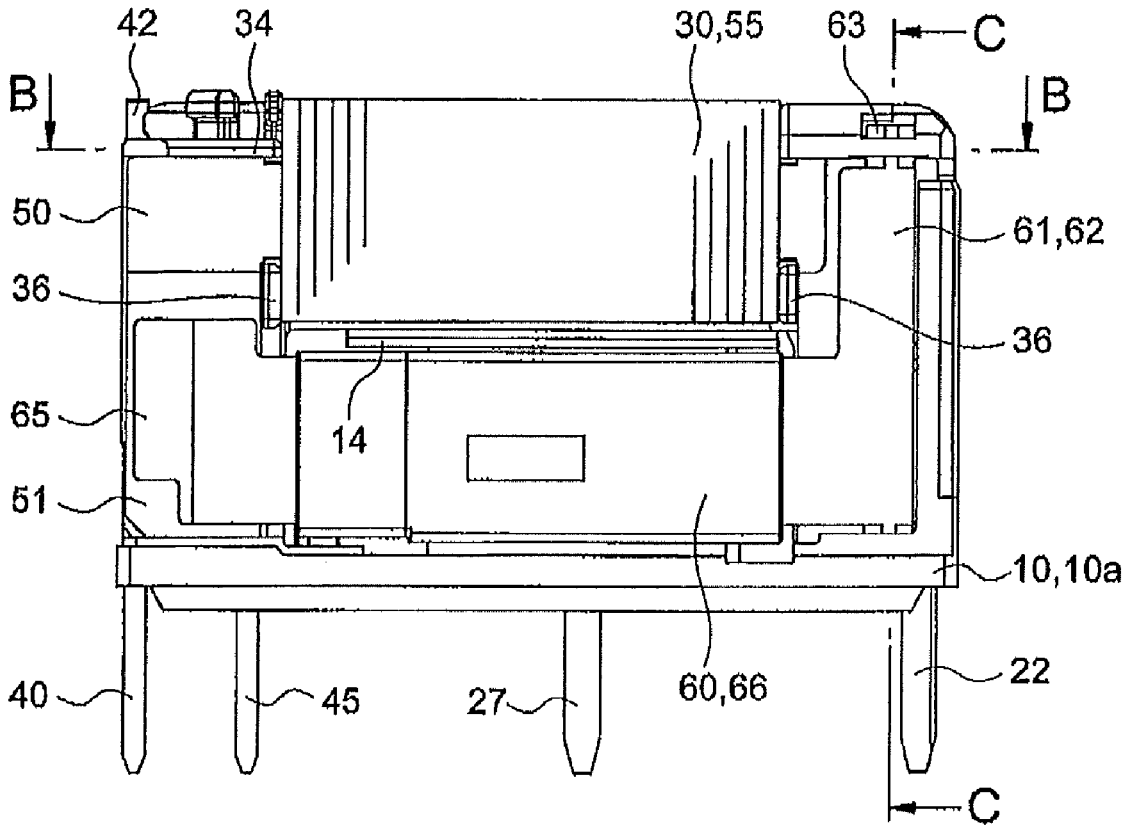
FIG. 8A is a front view of the electromagnetic relay shown in FIG. 2, and FIGS. 8B and 8C are cross-sectional views of FIG. 8A taken along lines B-B and C-C respectively.
Figure 8B:
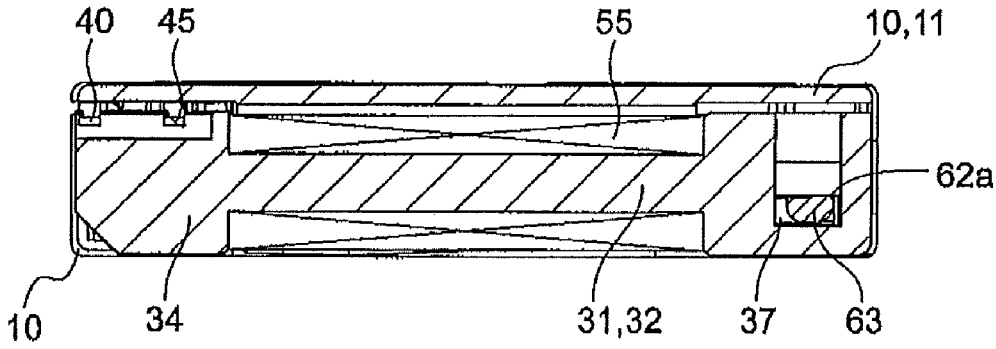
Figure 8C:
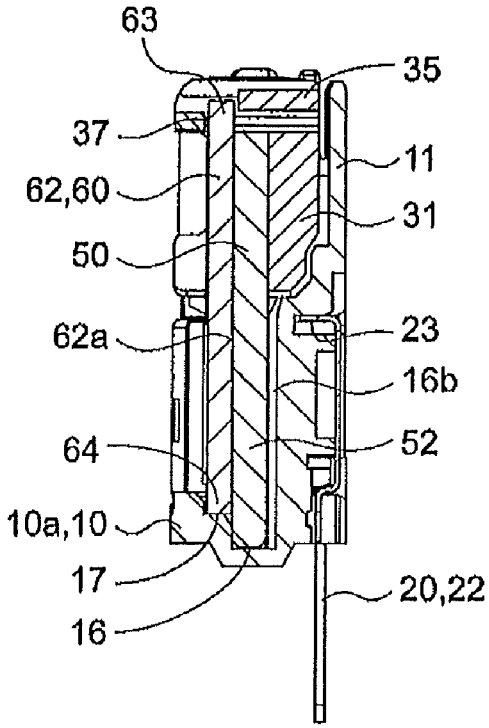

Further, a shaft hole 37 is formed in the joint 35 to rotatably support the armature 60 as shown in FIGS. 4B and 8B. In this embodiment, since the shaft hole 37 is formed in the joint 35 as a single part, accuracy of positioning may be increased, thereby variation in operating characteristics may be advantageously suppressed.

Figure 7A:
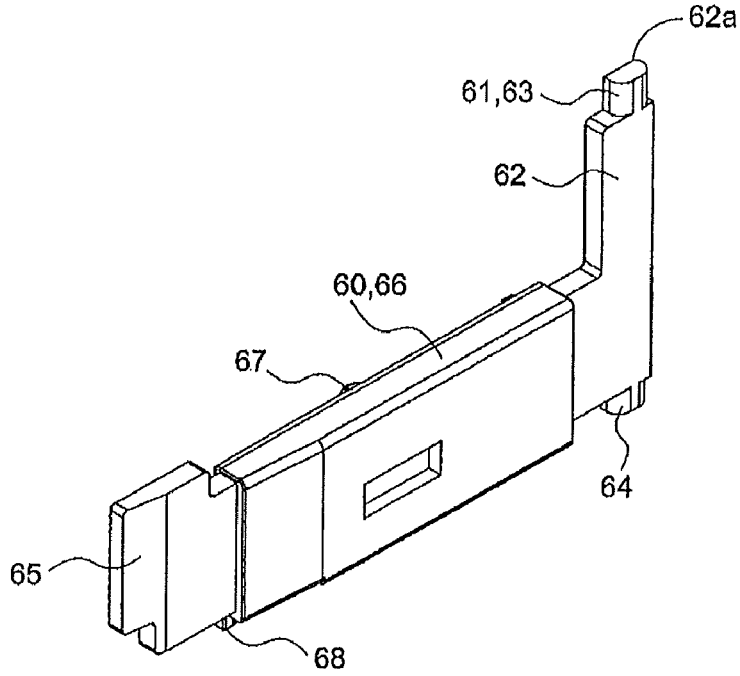
FIG. 7A is a perspective view of the armature shown in FIG. 2
Figure 7B:
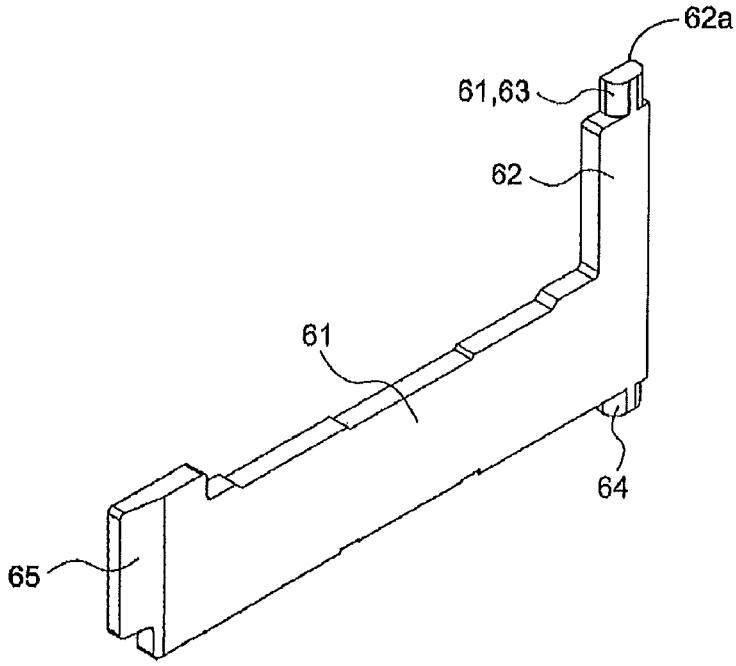
FIG. 7B is a perspective view of a movable iron piece.

The armature 60 includes a substantially L-shaped movable iron piece 61 having rotating shaft 62 formed vertically at one end and an pulled part 65 at the other end as shown in FIG. 7. The movable iron piece includes an operational projection 67 projecting from the inner surface and a stopper 68 at the lower end formed through outsert molding of an insulating material 66. In addition, upper and lower ends of the rotating shaft 62 have rotating-shaft convex portions 63 and 64 projecting along the same shaft center respectively. The rotating shaft 62 has a flat surface in the side of the operational projection 67, and an edge of the flat surface becomes a rotational axis 62*a*, while outer surfaces of the rotating-shaft convex portions 63 and 64 are formed to be curved surfaces.

Figure 1:
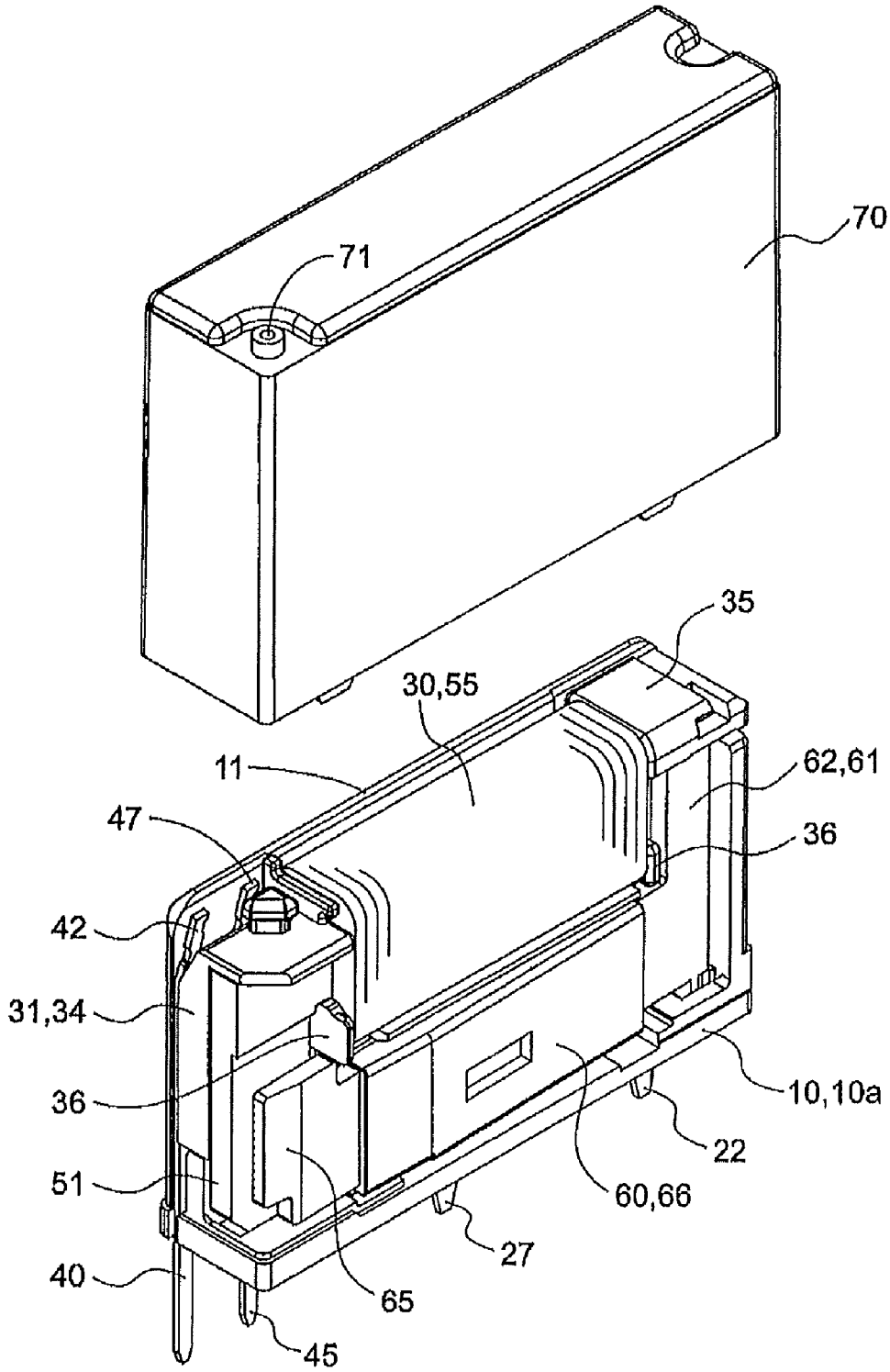
FIG. 1 is an exploded perspective view showing a first embodiment of an electromagnetic relay according to the present invention.

The case 70 is box-shaped and configured to be engaged with the base 10 on which the electromagnetic block 30 and the armature 60 are mounted, having a vent hole 71 at the corner of the upper surface as shown in FIG. 1.

Next, a method of assembling the electromagnetic relay including above-mentioned parts is described.

Figure 2:
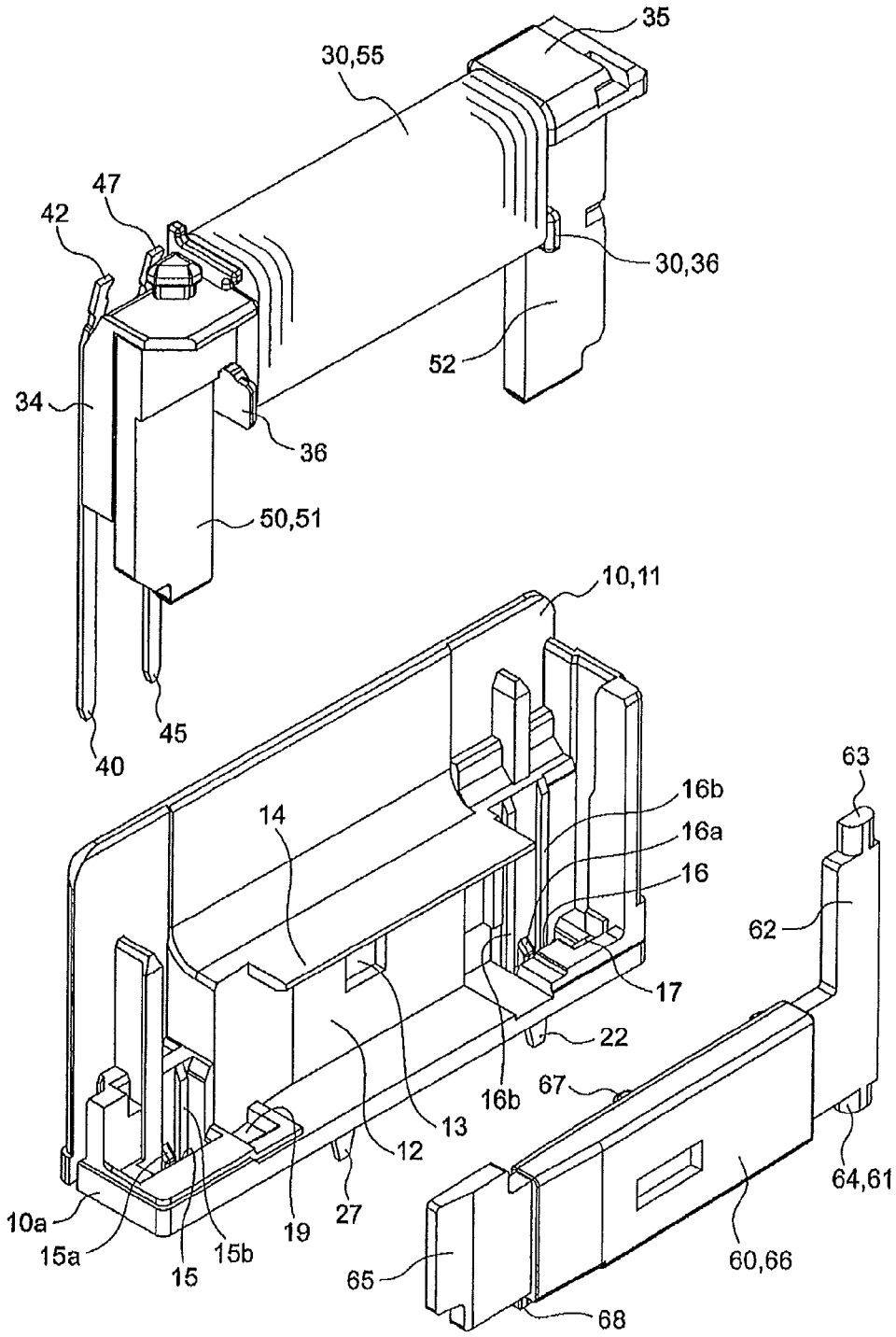
FIG. 2 is an exploded perspective view showing a major part of the electromagnetic relay shown in FIG. 1.

First, both ends 51 and 52 of the iron core 50 of the electromagnetic block 30 are press-fitted halfway into the concave portions 15 and 16 of the base 10 respectively and temporarily joined there as shown in FIG. 2. Since both ends 51 and 52 of the iron core 50 are pushed into the concave portions 15 and 16 with the lower end surfaces being pressed against press-fit projections 15*a* and 16*a* of the base 10, shavings are produced from the press-fit projections 15*a* and 16*a*. The shavings produced in this process (not shown) enter the shaving receptacles 15*c* and 16*c* and are held there (FIG. 10B).

Figure 11A:
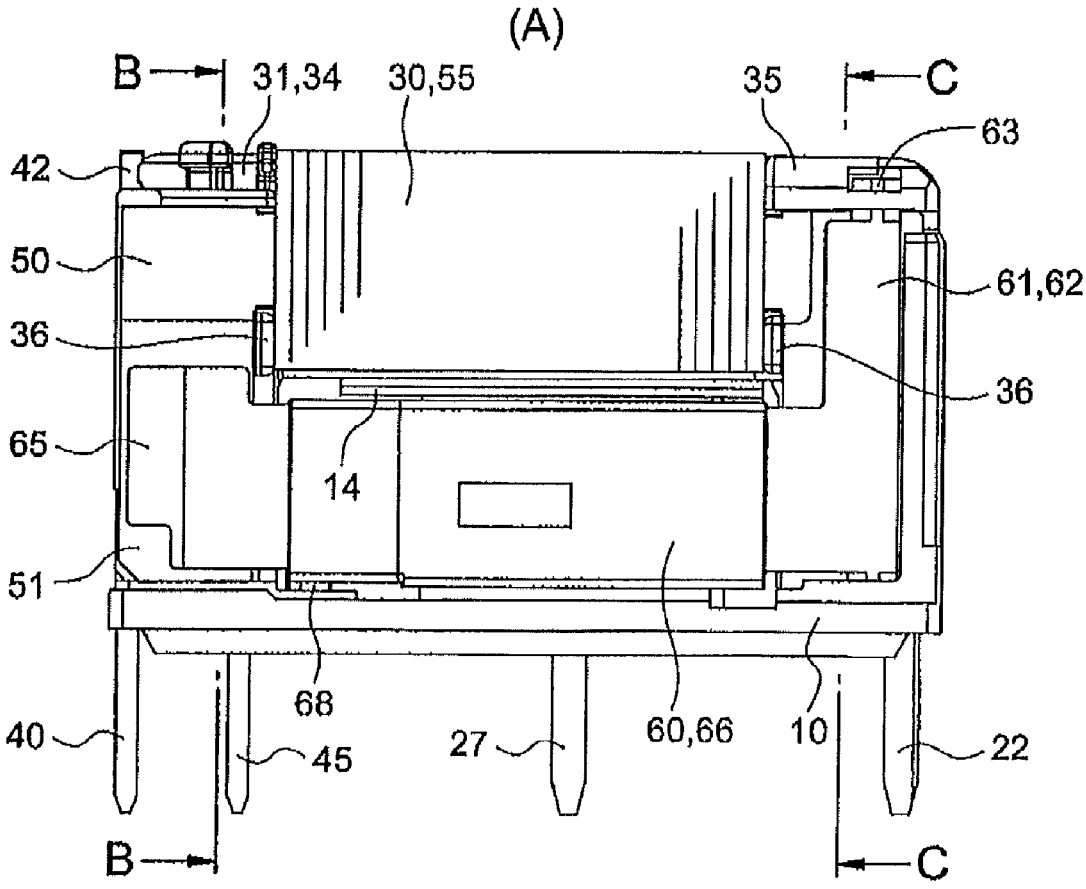
FIG. 11A is a front view of the electromagnetic relay shown in FIG. 2, and FIGS. 11B and 11C are enlarged cross-sectional views of FIG. 11A taken along lines B-B and C-C respectively.
Figure 11B:
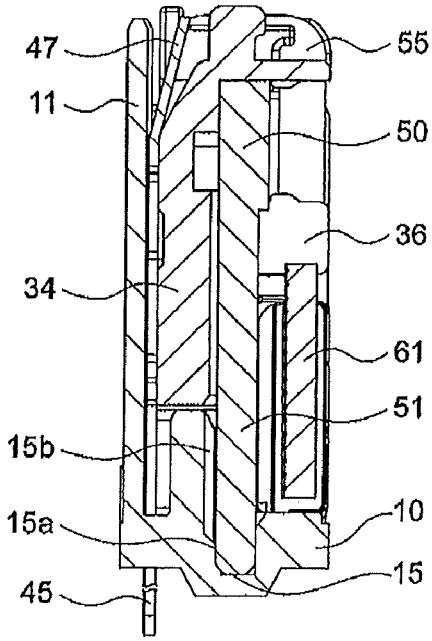
Figure 11C:
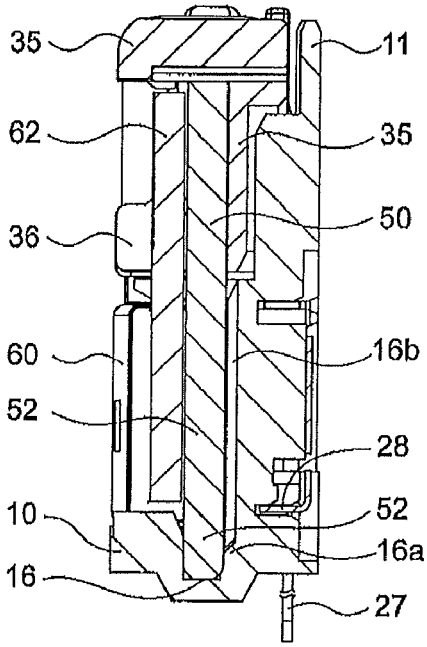

In particular, since the joints 34 and 35 of the spool 31 extend to the tops of the separating ribs 15*b* and 16*b* to serve as lids to the shaving receptacles 15*c* and 16*c* as shown in FIGS. 11B and 11C, the shaving receptacles 15*c* and 16*c* are separated substantially by 6 surfaces. Thus, the shavings are prevented from being scattered and lost, and bad electrical contact and failure of operation caused by such scattered and lost shavings may be advantageously avoided.

In FIG. 10B, although enlarged space is shown between the one end 51 of the iron core 50 and the concave portion 15 of the base 10, there is actually little space between both parts and shavings are likely to enter the shaving receptacle 15*c* as it has comparatively small friction when the shavings enter therein. As such, shavings are eventually held in the shaving receptacles 15*c* and 16*c*. The shaving receptacles 15*c* and 16*c* may be provided at least one side of the press-fit projections 15*a* and 16*a* closer to the contacts 21 and 26.

Further, the separating ribs 15*b* and 16*b* and the both ends 51 and 52 of the iron core 50 are configured to create as little space as possible between them so as not to contact each other within dimension tolerance of each part, such that the shavings are difficult to get out of the shaving receptacles 15*c* and 16*c* once they fall therein.

Next, the rotating-shaft convex portions 64 of the armature 60 is inserted into the bearing part 17 of the base 10 from obliquely above while the stopper 68 is inserted into the positioning concave portion 19 from obliquely above to be positioned in a vertical direction as shown in FIG. 2. Then, the other rotating-shaft convex portions 63 is inserted into and rotatably supported by the shaft hole 37 that is provided at the joint 35 of the spool 31 while the temporarily joined electromagnetic block 30 is pushed down to a predetermined position. As such, the rotating shaft 62 of the armature 60 is positioned with the rotational axis 62*a* provided at an edge of the flat face having line contact to the iron core 50 as shown in FIGS. 8B and 8C. In this way, the rotating shaft 62 is positioned relative to the iron core 50 only through the shaft hole 37 that is formed on the spool 31 for the upper end and the bearing part 17 of the base 10 for the lower end. Thus, adverse effect on operating characteristics caused by variation in part dimension can be advantageously minimized.

Then, the case 70 is engaged with the base 10 as shown in FIG. 1, a sealing agent is applied between the base 10 and the case 70, and the sealing agent is hardened by heating. Heated and swollen air inside the case 70 is discharged outside through the vent hole 71. The assembling operation is completed by heat-sealing the vent hole 71.

Figure 9A:
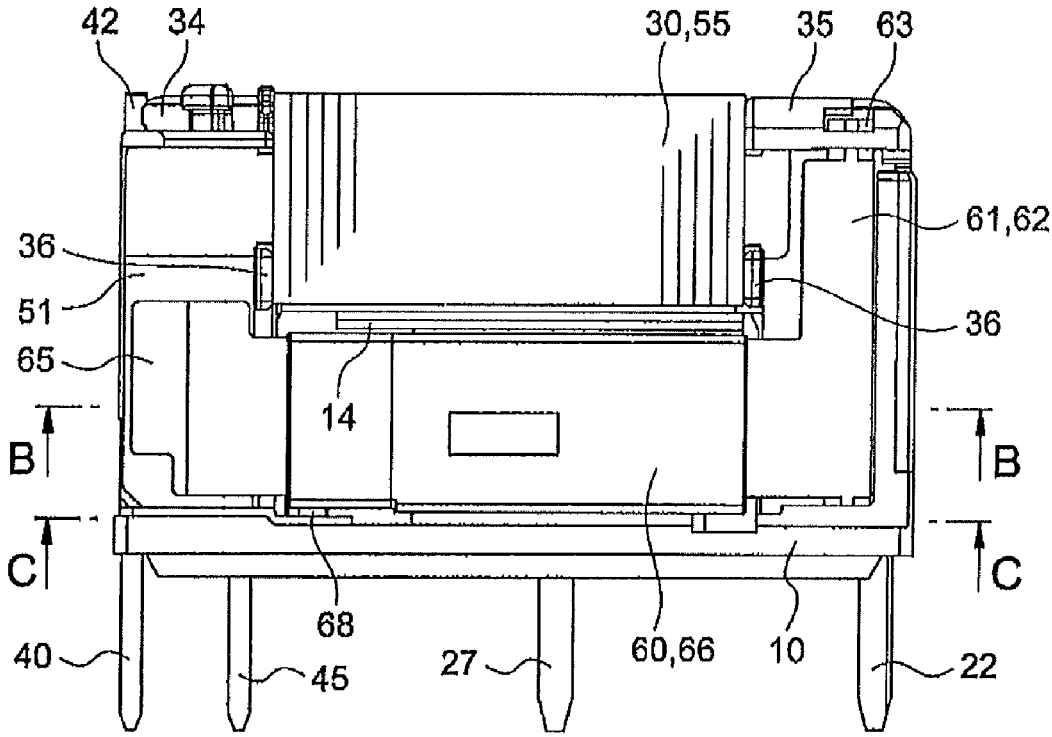
FIG. 9A is a front view of the electromagnetic relay shown in FIG. 2, and FIGS. 9B and 9C are cross-sectional views of FIG. 9A taken along lines B-B and C-C respectively.
Figure 9B:
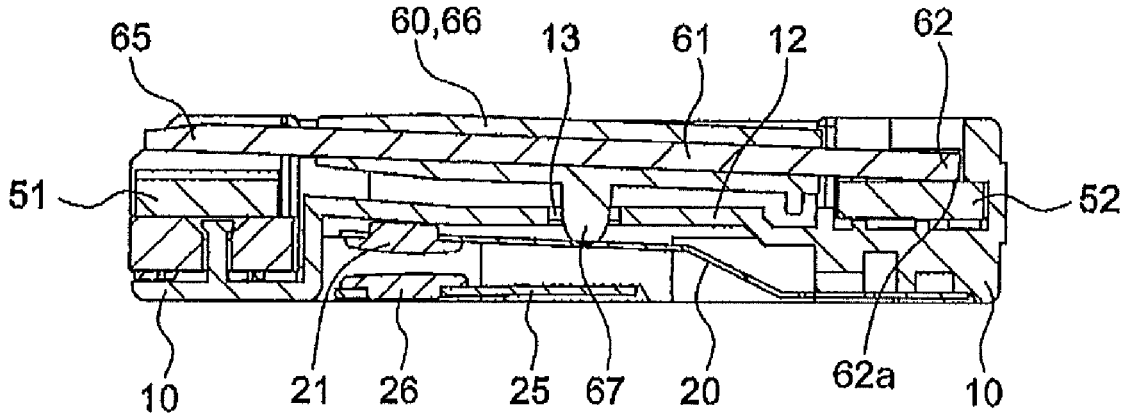

Operation of the electromagnetic relay is described with reference to FIG. 9. When a voltage is not applied to the coil 55, the operational projection 67 of the movable iron piece 61 is biased by a spring force of the movable contact piece 20*a* and the movable contact 21 is separated from the fixed contact 26. The stopper 68 of the armature 60 contacts with inner surface of the positioning concave portion 19, thereby the pulled part 65 of the movable iron piece 61 is restrained in a position.

When a voltage is applied to the coil 55 through the coil terminals 40 and 45, a magnetic pole part 51 at one end of the iron core 50 pulls the pulled part 65 of the movable iron piece 61, and the movable iron piece 61 rotates around the rotational axis 62*a* of the rotating shaft 62 against the spring force of the movable contact piece 20*a*. As such, the operational projection 67 presses the movable contact piece 20*a* to rotate it, thereby the movable contact 21 comes into contact with the fixed contact 26, then the pulled part 65 of the movable iron piece 61 is pulled to the magnetic pole part 51 at one end of the iron core 50.

Figure 9C:
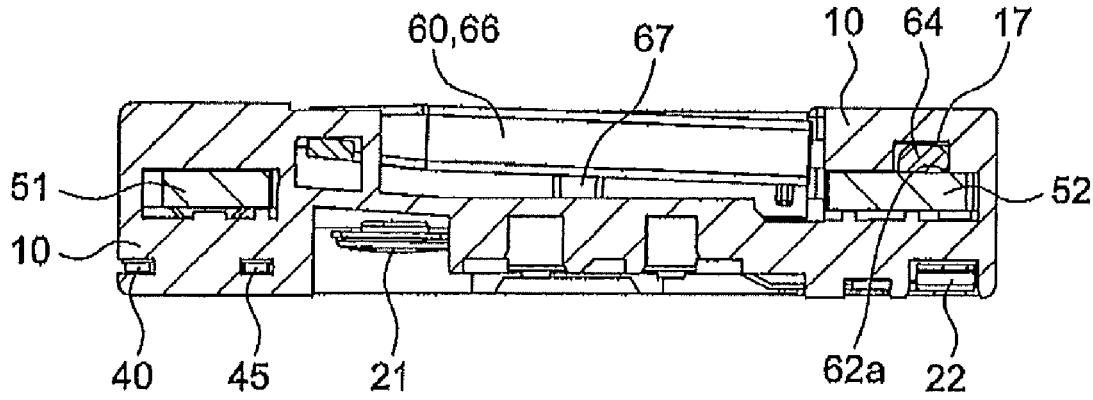

Further, when magnetization is terminated by releasing application of a voltage to the coil 55, the operational projection 67 is pushed back by the spring force of the movable contact piece 20*a*, thereby the armature is rotated in a direction opposite to the previous rotation and the movable contact 21 and the movable iron piece 61 return to their original positions. The outer surfaces of the rotating-shaft convex portions 63 and 64 opposite to the surface facing the iron core 50 are formed to be curved surfaces as shown in FIGS. 8B and 9C. As such, the rotation of the rotating shaft convex portions 63 and 64 may not be hindered by the shaft hole 37 or the bearing part 17.

According to one embodiment of the present invention, the shaving receptacles 15*c* and 16*c* are made between the press-fit projections 15*a* and 16*a*, and the separating ribs 15*b* and 16*b* that are formed in the press-fit concave portions 15 and 16 of the base 10 with five surfaces of the shaving receptacles

15*c* and 16*c* being closed. Since shavings produced while the iron core 50 is press-fitted enter the shaving receptacles 15*c* and 16*c*, and are held there, bad electrical contact and failure of operation caused by the shavings are prevented.

According to another embodiment of the present invention, the shaving receptacles 15*c* and 16*c* may be made at both sides of the press-fit projections 15*a* and 16*a* by forming the separating ribs 15*b* and 16*b* at both sides of the press-fit projections 15*a* and 16*a*. According to this embodiment, since the shaving receptacles 15*c* and 16*c* are made at both sides of the press-fit projections 15*a* and 16*a*, it is possible to capture the shavings more effectively and completely, thus preventing scatter and loss of the shavings. As such, bad electrical contact and failure of operation are prevented furthermore.

According to still another embodiment, a part of the spool 31 may be extended in proximity to an upper end of the shaving receptacle. According to this embodiment, the shaving receptacles 15*c* and 16*c* become closed space separated substantially by six surfaces, thus scatter and loss of the shavings are almost completely prevented and bad electrical contact and failure of operation caused by the shavings may be almost completely prevented.

The electromagnetic relay according to the present invention may be applied not only to the electromagnetic relays with the above-mentioned structures, but also to other electromagnetic relays as well.

The specific embodiments described above are intended to be non-limiting examples, and the invention may be practiced otherwise than as specifically described herein without departing from the scope thereof.

The invention claimed is:

1. An electromagnetic relay configured to open or close a contact by a movable iron piece rotated by magnetization or demagnetization of the iron core with a coil, the electromagnetic relay comprising:

a base having a press-fit concave portion on an upper surface thereof, and a press-fit projection formed in the press-fit concave portion, and an electromagnetic block having an iron core, the electromagnetic block supported by press-fitting both ends of the iron core into the upper surface of the base, wherein a separating rib is formed adjacent to at least one side of the press-fit projection to form a shaving receptacle.

2. The electromagnetic relay according to claim 1, wherein the shaving receptacle is formed at both sides of the press-fit projection by forming the separating rib at both sides of the press-fit projection.

3. The electromagnetic relay according to claim 1, wherein a part of a spool is extended in proximity to an upper end of the shaving receptacle.

* * * * *